United States Patent [19]

Bollmann

[11] 4,279,107

[45] Jul. 21, 1981

[54] SYSTEMS FOR ANCHORING STRUCTURAL MEMBERS

[76] Inventor: Jean-Jacques Bollmann, Flühgasse 49, CH-8008 Zurich, Switzerland

[21] Appl. No.: 63,495

[22] Filed: Aug. 3, 1979

[30] Foreign Application Priority Data

Aug. 3, 1978 [CH] Switzerland ..... 8259/78

[51] Int. Cl.[3] ..... E02D 27/42

[52] U.S. Cl. ..... 52/169.13; 52/296; 403/86

[58] Field of Search ..... 52/169.13, 127, 79.9, 52/149, 156, 165, 166, 167, 169.1, 169.9, 292, 295–297; 403/86; 256/21

[56] References Cited

U.S. PATENT DOCUMENTS

| | | | |
|---|---|---|---|
| 656,314 | 8/1900 | Beerbower | 403/86 |
| 1,659,527 | 2/1928 | Holmgreen | 52/166 |
| 3,289,369 | 12/1966 | Marcus | 52/296 X |
| 3,323,765 | 6/1967 | Fernandez | 52/296 X |
| 3,645,057 | 2/1972 | Kaplan | 52/295 |

FOREIGN PATENT DOCUMENTS

| | | | |
|---|---|---|---|
| 322265 | 6/1920 | Fed. Rep. of Germany | 52/169.13 |
| 511249 | 8/1939 | United Kingdom | 52/295 |
| 731703 | 6/1955 | United Kingdom | 52/295 |

*Primary Examiner*—J. Karl Bell

*Attorney, Agent, or Firm*—Pollock, Vande Sande & Priddy

[57] ABSTRACT

This invention relates to a system for anchoring structural members, such as structures made of round and profiled tubes of steel, non-ferrous metal, light-alloy and plastics. The object of the system is for tubular members of any size and load-bearing capacity to be erected vertically on any ground, irrespective of the slope or gradient and unevenness.

11 Claims, 5 Drawing Figures

SYSTEMS FOR ANCHORING STRUCTURAL MEMBERS

BACKGROUND OF THE INVENTION

This invention relates to a system for the underground anchoring of structural members, such as tubular structures. The object of the system is for tubular members of any size and load-bearing capacity to be erected vertically on any ground, irrespective of the slope or gradient and unevenness.

The system is especially suitable more for erecting small structures such as gates, posts, car-park boundaries, road markings, signs and notices, road and motorway barriers, fencing, hoardings, garden tables (tables for garden restaurants and open-air cafes), (public) benches and seats, children's playground equipment, garden umbrellas, rotary clothes lines, and so on.

The system is very versatile and also allows the erection of structures (sub-structures and shells), such as market stalls and stands, indoor and outdoor grandstands, hutments (standard and emergency hutments), awnings, passages, railings, bridge anchors (emergency bridges), and for military purposes, and so on.

More particularly, the system is intended for all small structures and the like which are temporarily and subsequently are usually intended to be removed.

SUMMARY OF THE INVENTION

The system according to the invention comprises an underground anchoring member in unlevelled ground, an upwardly extending section member being mounted in the member and bearing an adjusting mechanism in the form of an inclined bearing plate and, on the latter, a flange which is pivotable in the inclined plane of the plate and which is at an angle to a retaining member which, together with the flange, forms a fixed unit and which receives a top member, releasable fixing elements being provided on the bearing plate and on the flange, the whole arrangement being such that the top member together with the retaining member can be adjusted to, and locked in, any desired angle in relation to the ground by rotation of the bearing plate and the flange.

DESCRIPTION OF THE PREFERRED EMBODIMENTS

Figure 1:
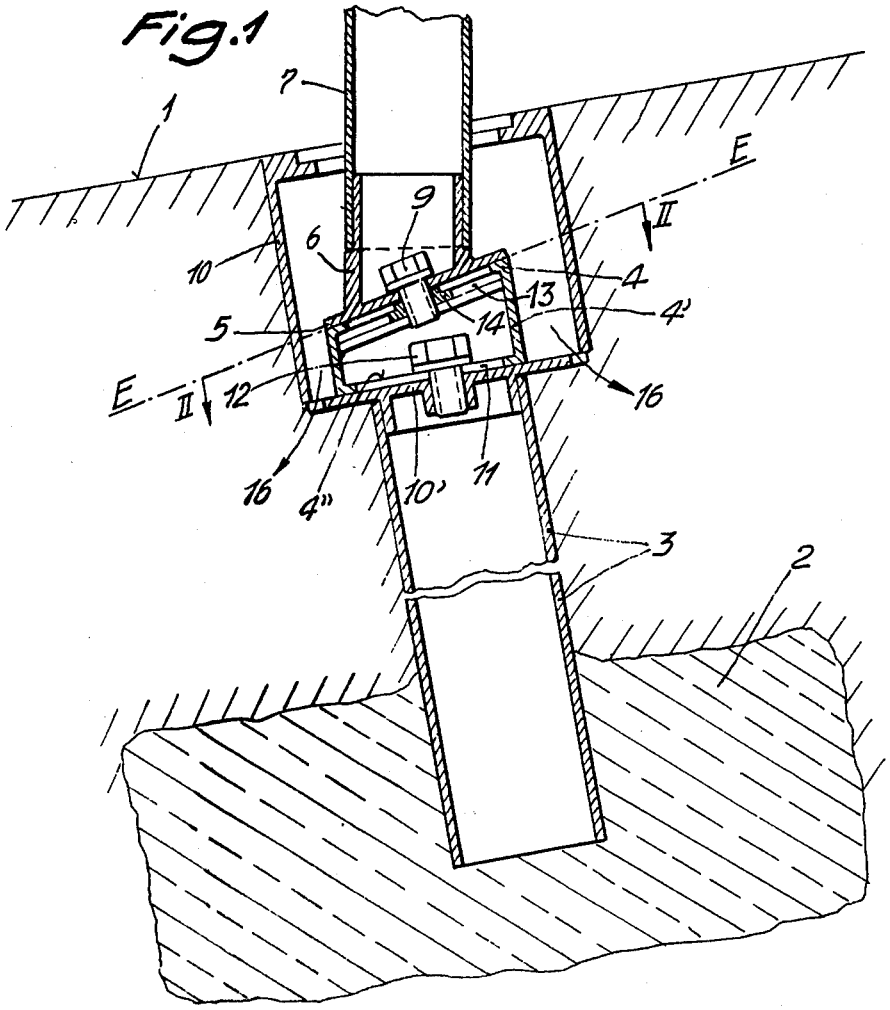
FIG. 1 is a vertical section through the underground-anchored system on sloping ground, with an article of use projecting upwardly.
Figure 2:
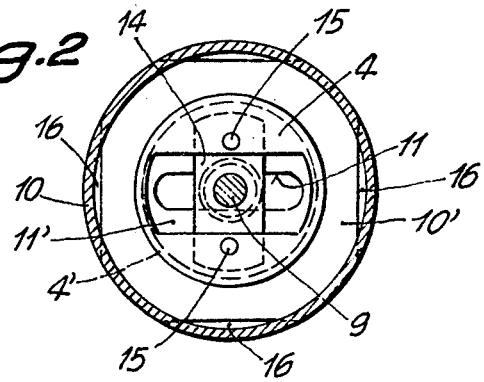
FIG. 2 is a plan view of the bearing plate perpendicularly to the inclined plane E—E.

Referring to FIG. 1, an upwardly extending section member 3 is fixed by an underground anchoring member 2 in ground 1, the gradient of which is immaterial, with the base 4″ of a bottom member 4′ extending in parallel relationship to the gradient of ground 1. The bottom member 4′ forms an adjusting means and is provided with a bearing plate 4 which is situated in a plane E—E inclined at an appreciable angle in relation to the base 4″ of the bottom member 4′. A flange 5 bears against bearing plate 4, with which it forms the adjusting mechanism, and joins a sleeve-shaped retaining member 6 which is disposed at an angle to flange 5. In particular, flange 5 is inclined an appreciable angle relative to a plane extending in a direction perpendicular to the longitudinal axis of retaining member 6. The retaining member 6 forms a sleeve or bush on to which a structural member or an article 7 can be fitted so as to be easily removable.

The flange 5 provided with the retaining member 6 is pivotally and lockably connected to a cross-member 14 of the bottom member 4′ by means of a screwbolt 9. The ends of the cross-member 14 engage in notches 13 situated opposite one another in the inner wall of the bottom part 4′ with cross-member 14 being lockable in its locking position by means of studs 15 extending through aligned openings in notches 13 and cross-member 14 as clearly shown in FIG. 1. The screw 9 is released the cross-member can be disengaged by rotation about the screw 9 so that the flange 5 can be removed from the bottom part 4′. When the cross-member 14 is in the locked position and the screwbolt 9 is released, the flange 5 including the retaining member 6 can be rotated through 360° as required. The base 4″ bears against the base 10′ of a casing 10 which is fixed on the section member 3 and the cover 10″ of which is flush with the ground 1. Apertures 16 are provided through the periphery of base 10′ of casing 10 to allow for the discharge of any water or the like which may enter or penetrate casing 10 when cover 10″ is removed. The base 4″ of the bottom member 4′ has a diametric slot 11 and is releasably connected to the base 10′ of the casing 10 by means of a screw 12 passing through said slot 11. When the screw 12 is released the bottom member 4′ together with its slot 11 can be displaced and pivoted as required so that the retaining member 6 together with the structural member 7 can be adjusted to a vertical position and be secured by means of the bolts 9 and 12 irrespective of the slope of the ground 1. When the structural member 7 has been removed, the casing 10 can be closed by means of a cover 10″.

Figure 3:
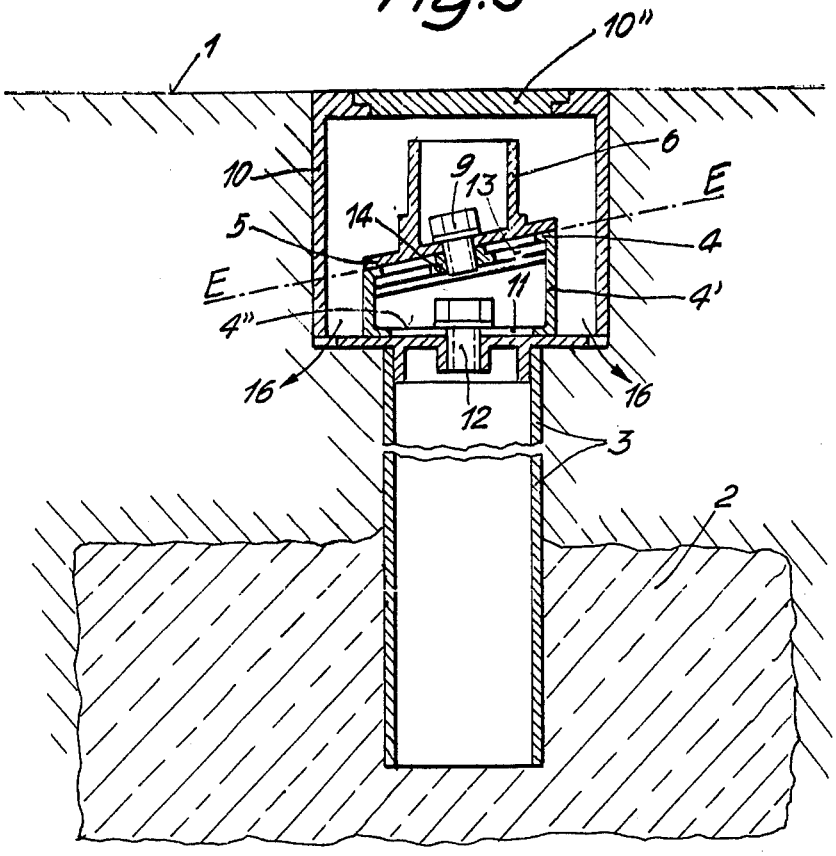
FIG. 3 is a vertical section through the underground-anchored system on horizontal ground in the inoperative condition.

On horizontal ground 1 as shown in FIG. 3, the adjusting mechanism 4, 5 is so adjusted and locked—by rotation of the bearing plate 4 and flange 5—that the retaining member 6 is perpendicular to the ground 1.

Figure 4:
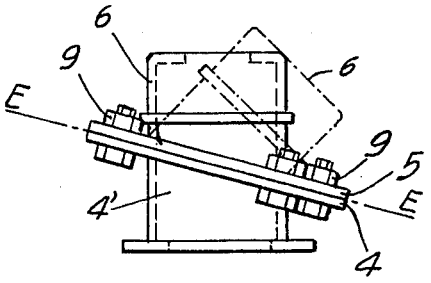
FIG. 4 is a variant of the adjusting mechanism used for adjusting the retaining member.
Figure 5:
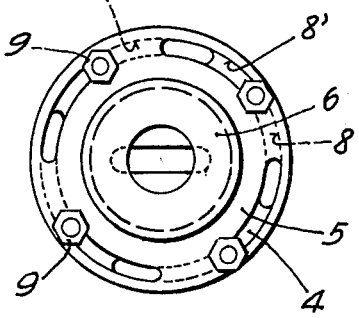
FIG. 5 is a plan view of FIG. 4.

In the variant of the adjusting mechanism shown in FIGS. 4 and 5, the bearing plate 4 and the flange 5 are of disc shape and have arcuate slots 8, 8′ near the periphery to allow the bearing plate and the flange 4 and 5 respectively to be pivoted through approximately 360° with respect to one another. The bearing plate and the flange are connected by screw means 9 which allow the members to be locked in the position selected.

I claim:

1. A system for adjustably anchoring a structural member in ground regardless of surface gradient, and comprising:

a section member fixedly positioned in a portion of an opening extending beneath ground, said section member including both upper and lower end portions, with the upper end portion positioned more closely to the ground surface than said lower end portion;

a separate retaining member also positioned within said opening and including a substantially sleeve-shaped upper end portion integrally attached to a substantially flange-shaped lower end portion, with the sleeve-shaped upper end portion engaging an end portion of a structural member extending into said opening;

inclined adjusting means for adjustably coupling said flange-shaped lower end portion of said retaining member to said section member to provide for selective positioning of the longitudinal axis of the structural member relative to the ground surface;

said inclined adjusting means comprising a one-piece bearing plate assembly rotatably and slidably mounted on the upper end portion of said section member, said bearing plate assembly including a first planar bearing surface confronting said retaining member, said first bearing surface being inclined an appreciable angle relative to an imaginary plane extending perpendicular to a longitudinal axis of said section member;

said inclined adjusting means further comprising said flange-shaped end portion of said retaining member including a second, planar bearing surface contacting said first bearing surface, said second bearing surface being inclined an appreciable angle relative to an imaginary plane extending perpendicular to a longitudinal axis of said sleeve-shaped portion of said retaining member;

whereby relative sliding and, or rotative movement of said first and second inclined bearing surfaces causes a corresponding re-orientation of the longitudinal axis of the structural member attached to the retaining member.

2. A system according to claim 1, wherein said adjusting means further comprises fastening means engaging said retaining member and said bearing plate assembly for removably clamping said first and second bearing surfaces into non-slip engagement with one another.

3. A system according to claim 2, wherein said fastening means comprises a cross-member rotatably retained within said bearing plate assembly and having an aperture aligned with an aperture formed through the flange-shaped lower end portion of said retaining member, said fastening means further comprising a screw bolt extending through said aligned apertures for selectively drawing said second bearing surface into clamping engagement with said first bearing surface assembly.

4. A system according to claim 3, wherein said cross-member includes opposite end portions selectively engageable with a pair of notches formed in side walls of said bearing plate assembly for securing said cross-member against movement toward said retaining member.

5. A system according to claim 1, wherein each of said first and second bearing surfaces is of substantially disc-shaped configuration.

6. A system according to claim 5, wherein arcuately-shaped overlapping slots are formed through the periphery of each of said substantially disc-shaped bearing surfaces, with a plurality of fastening members extending through said overlapping slots for selectively clamping said disc-shaped bearing surfaces into non-slip contact with one another.

7. A system according to claim 1, wherein a hollow casing is positioned within said opening formed in the ground, said hollow casing enclosing said adjusting means and including an opening formed through an upper end portion positioned substantially flush with the ground surface, said hollow casing including a further, lower end portion attached to said section member.

8. A system according to claim 7, wherein at least one drainage aperture is formed through a wall portion of said hollow casing to allow for drainage of water or the like entering said casing through said opening in said upper end portion.

9. A system according to claim 7, wherein a cover member is selectively positionable so as to cover the opening formed through the upper end portion of said hollow casing when a structural member is not attached to said retaining member.

10. A system according to claim 1, wherein said bearing plate assembly includes a bottom member attached to said section member, said bottom member extending substantially perpendicular to the longitudinal axis of said section member, wherein said longitudinal axis of said section member extends substantially perpendicular to the ground surface.

11. A system according to claim 10, wherein the lower end portion of said section member is attached to an underground anchoring member embedded beneath the ground surface.

* * * * *